US005677822A

United States Patent [19]

Cohen et al.

[11] Patent Number: 5,677,822

[45] Date of Patent: Oct. 14, 1997

[54] STATIC DISCHARGE WRISTBAND HAVING SUBSTANTIALLY UNIVERSAL DUAL SNAP CONNECTOR

[75] Inventors: Lenard Cohen, Southboro; Robert W. Weir, Westboro, both of Mass.; Robert J. West, Alta Loma; Mark E. Hempel, Chino Hills, both of Calif.

[73] Assignee: Desco Industries, Inc., Walnut, Calif.

[21] Appl. No.: 540,900

[22] Filed: Oct. 11, 1995

[51] Int. Cl.[6] ..... H05F 3/02

[52] U.S. Cl. ..... 361/220

[58] Field of Search ..... 361/212, 220, 361/223, 224; 439/37, 669, 906, 86, 92

[56] References Cited

U.S. PATENT DOCUMENTS

| | | | |
|---|---|---|---|
| 4,373,175 | 2/1983 | Mykkanen | 361/220 |
| 4,402,560 | 9/1983 | Swainbank | 339/11 |
| 4,459,633 | 7/1984 | Vandermark | 361/220 |
| 4,558,309 | 12/1985 | Antonevich | 340/649 |
| 4,577,256 | 3/1986 | Breidegam | 361/220 |
| 4,605,984 | 8/1986 | Fielder | 361/220 |
| 4,639,825 | 1/1987 | Breidegam | 361/220 |
| 4,662,695 | 5/1987 | Gordon et al. | 339/14 R |
| 4,720,764 | 1/1988 | Weiss | 361/220 |
| 4,745,519 | 5/1988 | Breidegam | 361/220 |
| 4,755,144 | 7/1988 | Gordon et al. | 439/37 |
| 4,813,459 | 3/1989 | Breidegam | 139/421 |
| 4,816,964 | 3/1989 | Weiss | 361/220 |
| 4,998,178 | 3/1991 | Weiss | 361/220 |
| 5,004,425 | 4/1991 | Hee | 439/37 |
| 5,018,044 | 5/1991 | Weiss | 361/220 |
| 5,134,538 | 7/1992 | Weiss | 361/220 |
| 5,184,274 | 2/1993 | Weiss | 361/220 |

OTHER PUBLICATIONS

Plastic Systems, "Materials and Systems for Static Control" 1989 Catalog, p. 14, under the heading Fixed Size. No date.

*Primary Examiner*—Fritz Fleming
*Attorney, Agent, or Firm*—Richard L. Gausewitz

[57] ABSTRACT

A dual conductor wristband utilizing a two-wire tether having a greatly modified single snap design. The wristband includes a strap (band) and a connector case, the case having a male snap for receiving a dual connector female socket. The male snap incorporates a plunger and a conductive rubber washer that activates the plunger so there is always electrical contact in both electrical circuits. The invention may be used with dual line constant resistance, capacitance, impedance, and non-monitored systems.

19 Claims, 3 Drawing Sheets

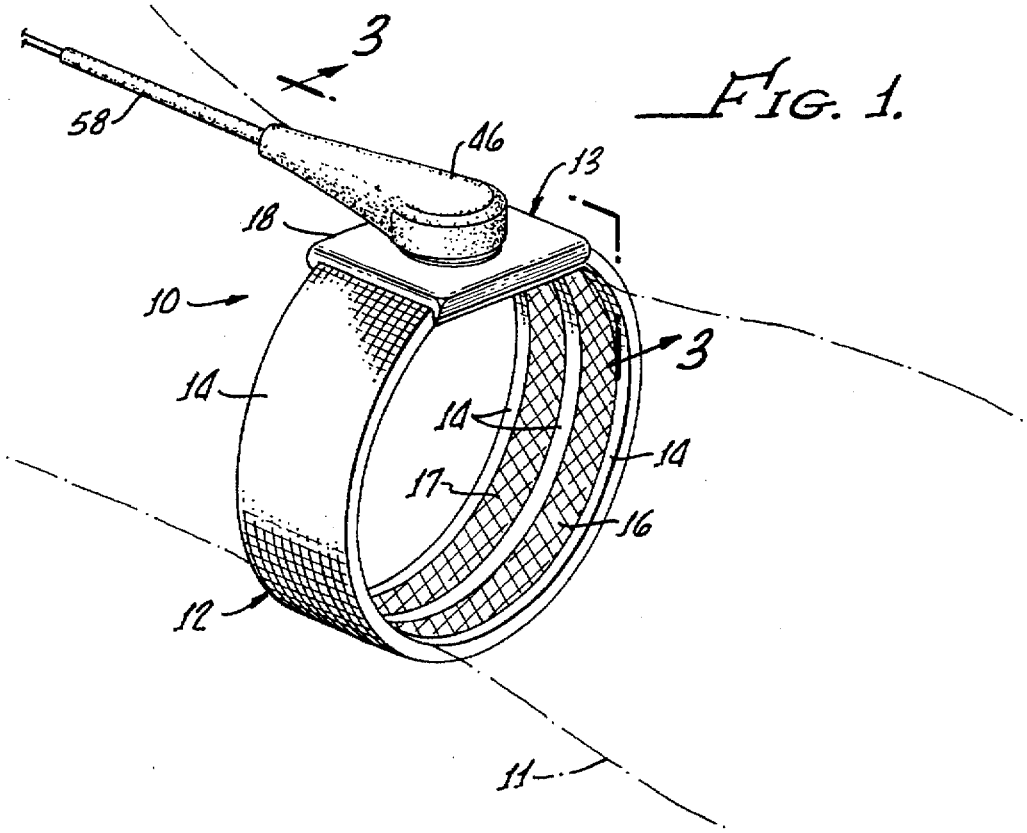
FIG. 1.
FIG. 2.
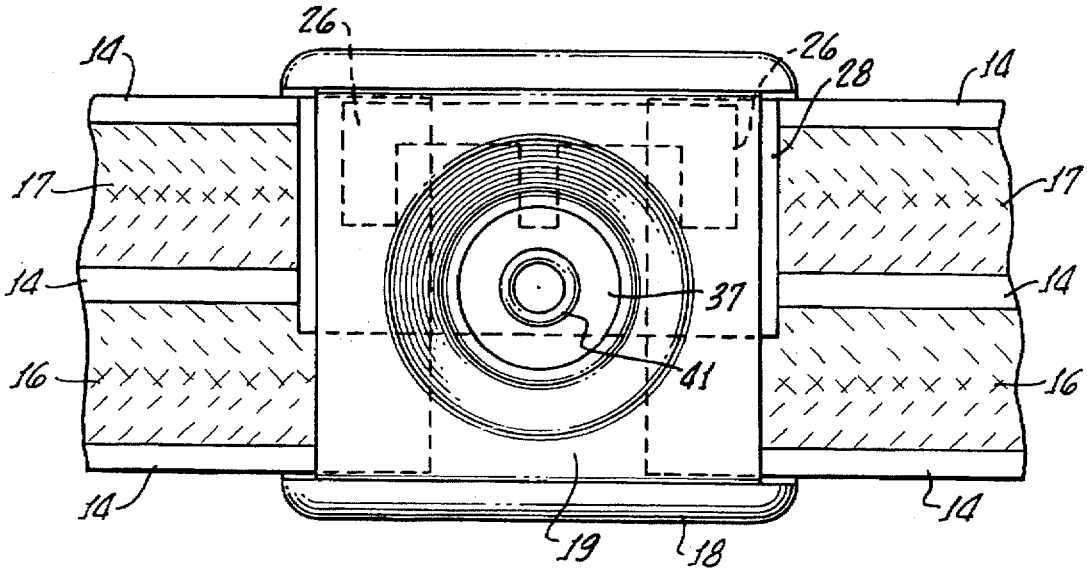

STATIC DISCHARGE WRISTBAND HAVING SUBSTANTIALLY UNIVERSAL DUAL SNAP CONNECTOR

BACKGROUND OF THE INVENTION

In this age of high-tech microelectronics, the same large factory may have one substantial group of employees (workers) who use dual-path constant-monitoring electrostatic grounding devices and elements, and another large group of employees who use single-path electrostatic grounding devices and elements. The dual-path devices are for the more sensitive products, and the worker's grounding circuits are monitored to assure that no undetected failure in the grounding circuits occurs.

It would be a major benefit if one or more employees in either group could immediately change from the dual-path portion of the factory to the single-path portion, or in the opposite direction, without changing wristbands. This would save time, promote maximum use of equipment, etc.

In a different situation, let it be assumed that a particular factory already has large numbers of single-path grounding equipment. Assume also that management wishes to engage in manufacturing operations requiring dual-path (monitored) grounding devices. It would be a distinct benefit if the change did not have to be made all at once, and/or if the manufacturer could convert only a certain portion of the employees to monitored grounding, with the knowledge that various employees from the monitored-grounding group could at any time switch over to the original portion of the factory where single-path grounding is still employed.

There exists grounding equipment in which there are two separate side-by-side snaps (connectors). These, however, have the important disadvantage that when a grounding cord is connected to both snaps the cord cannot pivot around—or the employee cannot turn around—without twisting the cord. It is highly desirable that the worker be able to readily pivot his or her arm around at a work station, without tangling or twisting the cord. Furthermore, it is important that pulling on the ground cord will easily disconnect it, which is not the case when there are two connections.

SUMMARY OF THE INVENTION

The present invention comprises a highly practical, safe and effective coaxial snap connection in which there are two separate grounding circuits so that the connection may be employed in monitored grounding, which snap connection may also be employed in almost any commercial single-path grounding system.

The present invention also comprises a dual-path grounding connection that is single axis, and in which the two components rotate relative to each other so that the grounding cord will not twist or wind in response to movements of the worker using the equipment.

The invention also comprises a dual-path snap connection in which the snap connects and disconnects very easily and safely.

In accordance with one aspect of the invention, the dual grounding connection incorporates an effective resilient element that operates in a very small space and does not readily take a permanent set, and that conducts electricity so that it is assured that the associated grounding path will not be broken.

In accordance with another aspect of the invention, the receptacle portion of the dual-grounding device is effective and economical, and is adapted to connect to almost any commercial single-path grounding snap.

Stated in more detail, the invention comprises a one-snap product such that there is 360 degree rotation, to thereby achieve comfort and also safety of release. The product can be made in the common size (10 mm or 7 mm) in the preferred form, so that it will mate with conventional non-dual path products or systems using capacitance, resistance or impedance properties of the wearer. Thus, the present product performs satisfactorily with substantially all systems.

Stated more specifically, in accordance with another aspect of the invention, the present contact system uses a conductive rubber gasket or spring such that electrical contact is present at all positions of the snap. A conventional snap element is employed to achieve constant monitoring, without breaking of a circuit at any time. The invention includes a plunger assembly that incorporates a conductive rubber washer or gasket, such washer both activating the plunger so that there will always be electrical contact, and maintaining the stud and snap receptacle in physical contact in both electric circuits.

The invention further comprises a highly practical and effective dual-path receptacle combination.

BRIEF DESCRIPTION OF THE DRAWINGS

FIG. 1 is an isometric view of a wristband combination, incorporating the invention, as mounted on the arm of a person;

FIG. 2 is an enlarged fragmentary view, looking upwardly from the interior of the wristband in the upper portion of FIG. 1;

DETAILED DESCRIPTION OF THE PREFERRED EMBODIMENT

Figure 3:
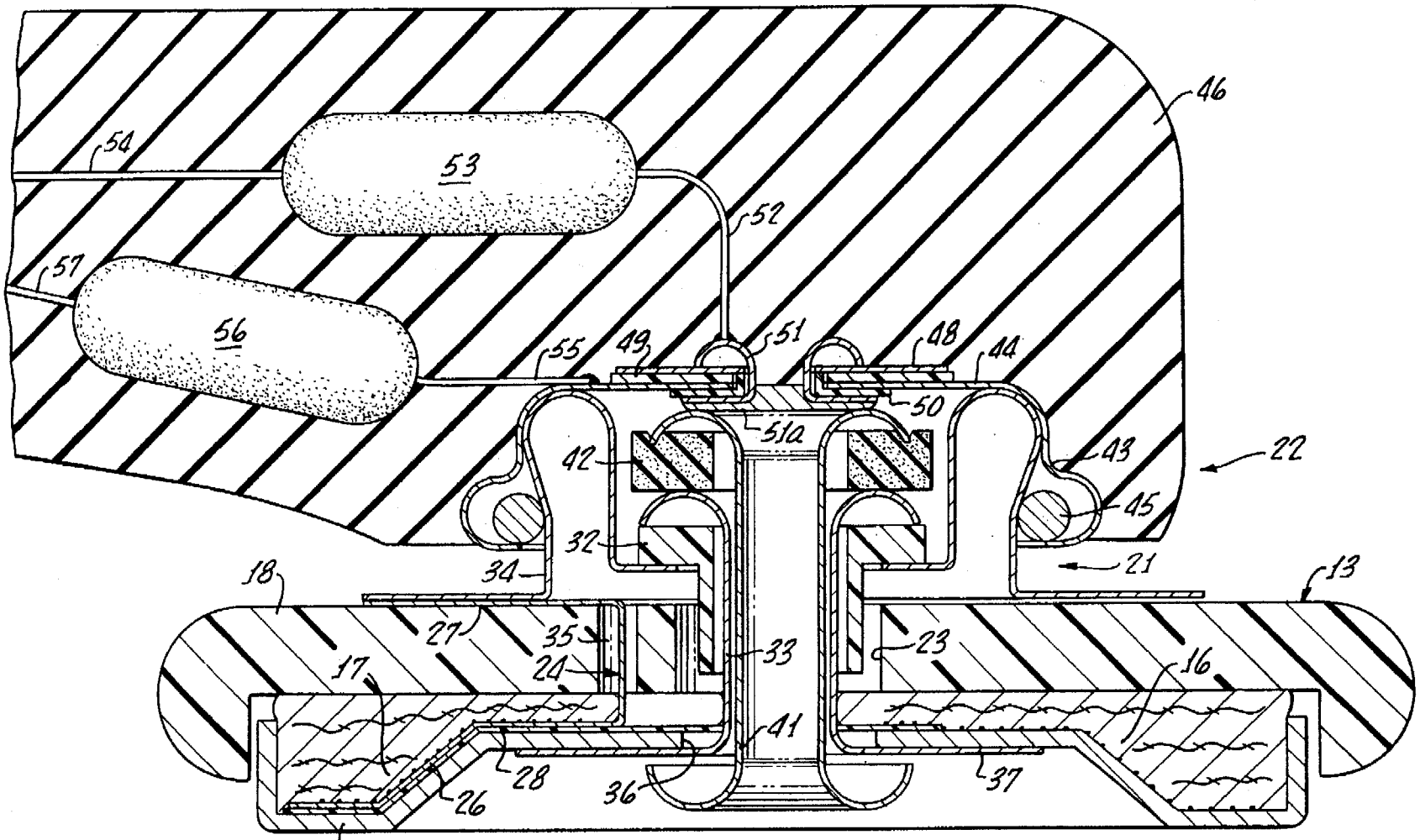
FIG. 3 is a greatly enlarged fragmentary sectional view on line 3—3 of FIG. 1.

The invention is described and illustrated in detail as including a cloth-type wristband, but it is to be understood that the dual snap connector may be associated with a metal band, with a smock or shop coat, or with other elements commonly employed in the electrostatic grounding art. Furthermore, although the present invention is described and shown in detail as employing resistive-type grounding circuits, it may alternatively (as above stated) be associated with circuits of the capacitance or impedance type, and also with non-monitored systems.

Referring to FIG. 1, a static discharge wristband 10 is illustrated as mounted on the wrist portion of the arm 11 of a person, typically a worker in a microelectronics factory. The wristband comprises a band or strap 12 the ends of which are connected by a buckle or connector case 13 (sometimes called a connector).

Band 12 is preferably a knit cloth band having nonconductive portions 14 and conductive portions 16,17. Conductive portions 16,17 extend parallel to each other longitudinally of the band 12, for the full length thereof, in side-by-side relationship but separated by a nonconductive portion 14. The ends (FIG. 2) of the band may or may not touch each other but normally do not; at no time it there connection between the conductive portions 16,17.

Buckle or connector case 13 comprises an insulating (insulative) cover 18 preferably molded of synthetic resin. Edge portions of the cover extend down and enclose the side edges of a buckle base 19 formed of stainless steel. A section of band 12 is cut off a supply roll, and the resulting two ends are sonic welded to cover 18. The sonic welding involves "melting" protuberances (not shown) on the underside of cover 18.

The substantially universal dual snap connector comprises, as shown in FIG. 3, a snap plug assembly 21 (snap stud assembly) and a snap-socket assembly (snap receptacle assembly). The snap portion of snap plug assembly is preferably located at the center of buckle 13, at a hole 23 in cover 18 (FIG. 4).

Figure 4:
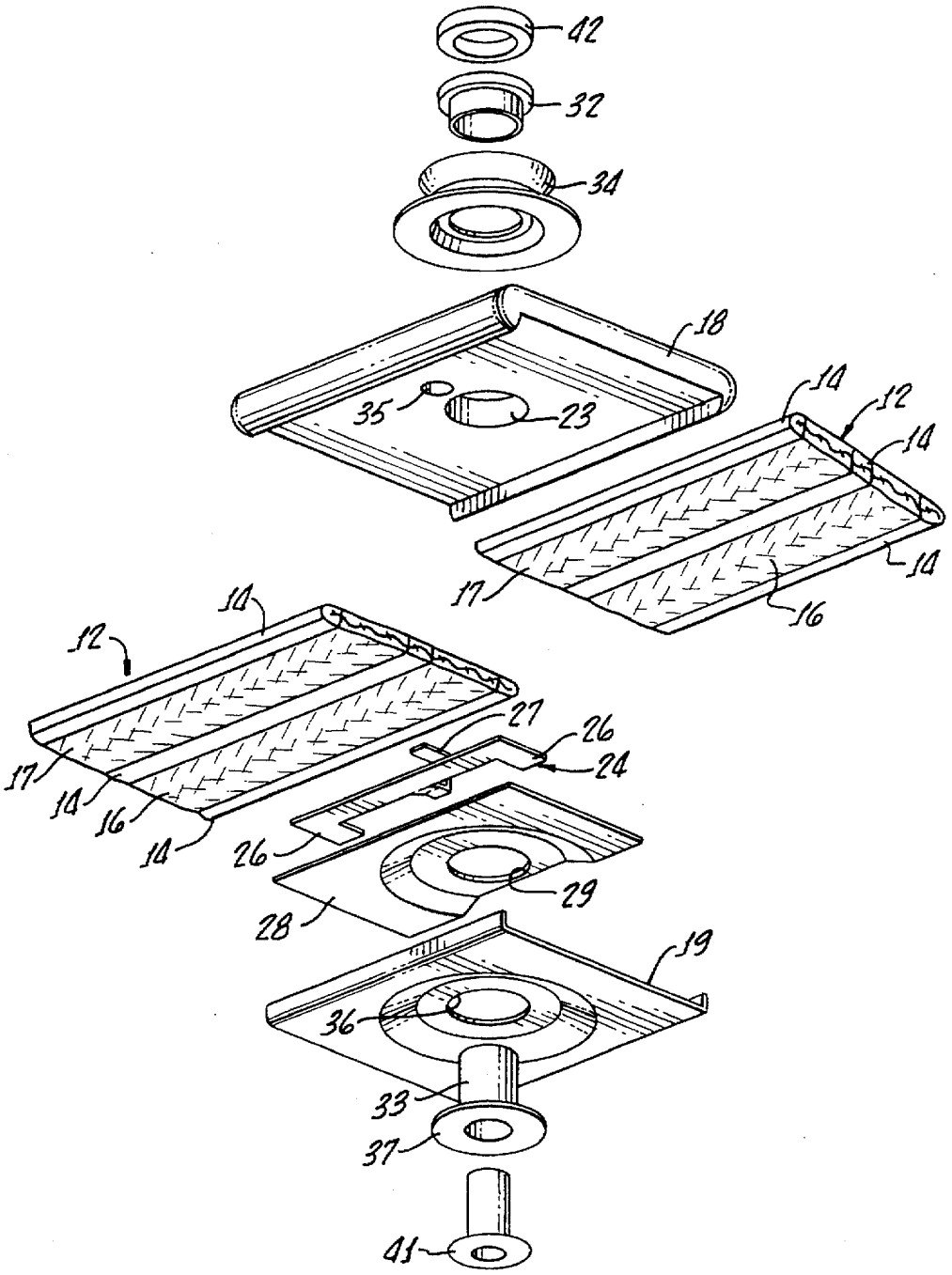
FIG. 4 is an exploded isometric view of the buckle and band and snap stud portion of the combination.

Proceeding first to a description of snap plug assembly 21, this comprises a conductor 24 having a plate portion 26 (shown as E-shaped but which may be rectangular or other shape) and a hook portion 27 as best shown in FIG. 4. It also comprises an insulator 28, preferable a sheet of mylar having a hole 29 therein that corresponds to hole 23 in cover 18. The assembly 21 also comprises a nylon shoulder washer 32, which is insulating, and a rollover eyelet 33. The cylindrical tubular portion of the shoulder washer is sized to fit into hole 23 in cover 18; the tubular portion of the eyelet 33 is sized to fit into the shoulder washer 32. A metal snap stud 34 is provided, and is further described below.

Conductor 24, insulator 28, shoulder washer 32, rollover eyelet 33 and stud 34 constitute a stationary portion of snap plug assembly 21. These are assembled as follows:

After the ends of band or strap 12 are sonic welded to the underside of cover 18, plate portion 26 of conductor 24 is positioned below both ends of conductive portion 17 of the band (FIG. 2), with hook portion 27 extended upwardly through a hole 35 of cover 18. A part of hook portion 27 lies on the upper surface of the cover (FIG. 3).

Mylar insulator 28 is positioned in something over half of base 19, so as to insulate conductive portion 17 of the band from the base 19. Thus, insulator 28 is sandwiched between base 19 and conductive portion 17, while plate portion 26 is sandwiched between insulator 28 and conductive portion 17. The tubular portion of rollover eyelet 33 is extended upwardly through a hole 36 in the center of base 19, through hole 29 in insulator 28, and through hole 23 and cover 18, so that the flange 37 at the bottom end of the rollover eyelet seats on the undersurface of base 19 at an upwardly-recessed portion of such base.

The snap stud 34 is seated on the upper surface of cover 18, and thus on that part of portion 27 of conductor 24 that lies on such upper surface. The tubular portion of nylon shoulder washer 32 is extended downwardly through the center of snap stud 34, around the tubular portion of rollover eyelet 33. The upper end of the tubular portion of the rollover eyelet is then rolled over to flare it outwardly and seat such upper end on the body of shoulder washer 32. Thus, the eyelet 33 firmly assembles the stated parts together, causing the sandwiched plate portion 26 of conductor 24 to be tightly in position between the conductive portion 17 of band 14 and the mylar insulator 28. Everything is rigidly and immovably fixed in place.

It is pointed out that snap stud 34 is a standard element that is widely manufactured and sold to various companies for various purposes. Even the preferred larger size of stud 34 is quite small (10 mm). Thus, there are both radial and vertical size constraints. Relative to the vertical constraints, there is an inwardly-extending flange on which shoulder washer 32 seats, and there is an outwardly extending flange at a somewhat lower level and that seats on the horizontal part of hook portion 27 and on the upper surface of cover 18. A large part of the vertical space within the cavity defined by the outer annular portion of stud 34 is taken up by washer 32 and by the rolled-over upper end of eyelet 33. Very little room is left thereabove, especially because the below-indicated cap or receptacle seats closely on the stud and has a horizontal wall spaced not very far above the upper end of the eyelet 33.

In accordance with one aspect of the invention, snap plug assembly 21 has not only the above-described stationary portion but has a vertically movable portion. Furthermore, the movable portion is resiliently biased in an upward direction by an element that does not require much space and that does not readily take a permanent set, and that aids in assuring that the circuits will not be broken at any time when the dual snap connector is in the illustrated closed condition. By having vertical movement, the ability to rotate, the effects of production tolerances, the effects of wear, the effects of variation in parts, etc., are compensated for in an effective way.

The movable portion of snap plug assembly 21 comprises a plunger in the form of a second, central eyelet 41 that is an elongate tube rolled over at both its upper and lower ends. Eyelet 41 is a first electrical contactor element. Eyelet 41, like eyelet 33, is a conventional brass rollover eyelet. Eyelet 41 does not perform any assembly function, acting instead as an electrically conductive contact plunger, electrical contactor element, contact seat, etc.

To provide a small-size, electrically conductive, permanent set-resistant element that biases contact plunger 41 upwardly, a conductive elastomeric washer or spring 42 is provided. Stated more specifically, the spring is sponge (or low-durometer elastomer, is sufficiently hard to effectively bias eyelet 41 upwardly against a cooperating electrical contactor element, and is sufficiently soft and so sized that it will not push the mated snap elements apart.

As a specific example, the resilient washer or spring 42 is an electrically-conductive carbon-filled elastomer sold by Griswold Rubber Company of Moosup, Conn., as number 9639 cushion sponge.

The lower end of eyelet 41 is (for example) rolled over prior to assembly, following which the eyelet 41 is inserted upwardly through eyelet 33. Washer 42 is then mounted on the upper end of eyelet 41, following which the upper end of the eyelet 41 is rolled over so as to confine the washer 42 between the two adjacent upper eyelet ends. The lower end of eyelet 41 is held against flange 37 of eyelet 33, by the resilience of the washer, except when eyelet 41 is pressed downwardly, as occurs when the snap connector is in the illustrated closed condition.

The outer diameter of conductive spring or washer 42 is sufficiently small that it is spaced a substantial distance inwardly from the interior cylindrical surface of stud 34. This is to make sure that the two electrical paths or circuits through the present connector are maintained separate from each other.

There is next described the snap socket assembly 22, with reference to FIG. 3. This comprises a metal snap receptacle or cap 43 that is a mass manufactured component adapted to mate closely with stud 34 as illustrated, the receptacle having a horizontal upper wall 44 extending across the extreme upper edge of the stud. At its lower edge, in an outwardly-extending annulus, there is a split ring 45 that acts as a spring to provide the snap action when the cap is pressed on or off the stud.

A synthetic resin body 46 is molded around receptacle 43 and around several other below-described elements, having a lower surface disposed at generally the same level as the open end of the receptacle.

A steel anchor washer 48 is molded into body 46 in a position spaced above wall 44 and parallel to and coaxial therewith. Below such washer is provided a nylon insulating washer 49 having a central hole therein that is concentric with that in anchor washer 48. A hole is provided in the upper wall 44 of receptacle 43, centrally of such wall. The tubular portion of a nylon shoulder washer 50 extends upwardly from below receptacle wall 44 through the hole in the receptacle and through that in the insulating washer 49. A brass rollover eyelet 51 extends through the shoulder washer 50 and through the three aligned holes in elements 48,49 and 44.

The upper end of the eyelet 51 is rolled over so that the eyelet is fixed firmly in position; furthermore, everything above receptacle wall 44 is embedded in the synthetic resin forming body 46. Such synthetic resin is preferably polyurethane, polyester, vinyl, or nylon. It is caused to the highly insulative, greater than one million megohms.

Eyelet 51, at its lower end, has a conductive bottom cap or contactor 51*a* that seats on the upper end of plunger or eyelet contactor 41 when the parts are in the illustrated closed condition. The relationships between eyelet 51, receptacle 43 and eyelet 41 are such that snapping of cap or receptacle 43 onto stud 34 causes contactor 51*a* to engage eyelet 41 and press it downwardly against the bias of elastomeric washer 42, thus assuring good electrical contact regardless of variations in parts and in production conditions and in wear. This presses the lower end of eyelet 41 off flange 37 to the illustrated position (for example) spaced from such flange.

Eyelet 51 has connected thereto a lead 52 that in turn connects through a resistor 53 and another lead 54 to the conventional ground cord or tether 58 (FIG. 1). The ground cord or tether leads to the conventional grounding and monitoring equipment. Another lead, number 55, connects receptacle 43 to a resistor 56 that in turn connects to a lead 57 leading to the ground cord 58. 0f course, the ground cord has separate leads connected to leads 54 and 57, which separate leads go all the way to the grounding equipment.

Operation

The static discharge wristband 10 (FIG. 1) is mounted on the arm 11 of a person, for example a worker in a micro-electronics factory. The housing 46, with its contained snap socket assembly 22 (FIG. 3), is easily snapped over the snap plug assembly 21, by pressing lightly so that spring 45 (FIG. 3) expands and then contracts as the receptacle moves downwardly to seated position. Grounding cord 58 is thus connected to the strap 12 or band, so that there are two separate and distinct grounding paths from the wearer to the grounding equipment to which cord 58 is connected.

The housing 46 and contained socket assembly pivot easily relative to the stud 34, so that cord 58 has only a minimum tendency to become twisted or wound up. At any time, the housing 46 and receptacle may be removed from the stud by applying only a light lifting force.

Instead of using the cord 58 and receptacle of the present invention, a conventional single-path cord and receptacle widely employed in the industry may be utilized. There is then only a single grounding path, but the same static discharge wristband 10 as that described herein is still utilized. This is a distinct convenience. The grounding path is one through the outer portion of the stud and through the associated receptacle in contact therewith.

The first grounding circuit, the one that is employed for either a single-path or dual-path grounding systems (and the one indicated in the preceding paragraph), may be traced as follows: The skin of the wearer, conductive portion 17 of band 12, plate portion 26 of conductor 24 (FIGS. 3 and 4), hook portion 27 of conductor 24, metal stud 34, receptacle 43, lead 55, resistor 56, lead 57 and ground cord 58 (FIG. 1) to the grounding equipment.

The second grounding path may be traced as follows: The skin of the wearer, conductive portion 16 of band 12, base 19, flange 37 of eyelet 33, the remainder of eyelet 33, conductive spring washer 42, the upper (seat) end of eyelet 41, the conductive cap 51a on the lower end of eyelet 51, the remainder of such eyelet, lead 52, resistor 53, lead 54 and grounding cord 58 to the grounding equipment.

Resistors 53,56 are high-value resistors (for example, 1 megohm each), that greatly increase the resistance of the grounding paths and thus greatly reduce the chances that any shock will occur. At the same time, such resistors allow safe dissipation of skin voltages from the body.

A safety and convenience advantage of the present single-stud dual grounding system occurs because body 46 and snap socket assembly 22 are very easily pulled off the snap 34. Let it be assumed, for example, that a worker forgets that he or she is connected to the grounding cord, and gets up and walks away from the workstation. There will then be a pulling force created on the cord 58, and this will pivot housing 46 upwardly from the plane containing cover 18, to easily disconnect the snap elements. This is to be contrasted with prior-art dual grounding systems, which either have two snap connections spaced from each other, or have a stereo-jack connection at a right angle. It is pointed out (FIG. 1) that the housing 46 is elongate and tapered, so that pulling on the cord 58 creates a crank or lever action lifting housing 46 to separate the snap connection.

The foregoing detailed description is to be clearly understood as given by way of illustration and example only, the spirit and scope of this invention being limited solely by the appended claims.

What is claimed is:

1. Apparatus for creating dual electrostatic discharge paths between a person and ground, comprising:

(a) skin-contacting means adapted to contact the skin of a person to receive electrostatic is charge therefrom;

(b) a snap connector, said snap connector having an electrically conductive snap stud portion mounted on said skin-contacting means, said snap connector having an electrically conductive snap receptacle portion adapted to snap on and off said snap stud portion, said snap receptacle portion and said snap stud portion being coaxial and being adapted to rotate relative to each other about their common axis, (c) first electric circuit means to create a first electrical path from said skin-contacting means to said snap stud portion and thence to said snap receptacle portion and thence to ground, (d) second electric circuit means to create a second electrical path from said skin-containing means through said snap stud portion and through said snap receptacle portion to ground, independently of said first electrical path, and (e) insulator means to insulate said first and second electrical paths from each other, said electric circuit means and said insulator means including conductor means extending through said snap stud portion and said snap receptacle portion, and means to insulate said conductor means from said snap stud portion and snap receptacle portion, said conductor means being coaxial with said snap stud portion and said snap receptacle portion.

2. The invention as claimed in claim 1, in which said conductor means includes a first contactor element mounted in said snap stud portion, and a second contactor element mounted in said snap receptacle portion, said first and second contactor elements being adapted to engage and electrically contact each other when said snap connector is in closed condition, at least one of said contactor elements being movable relative to the snap connector portion in which it is mounted.

3. The invention as claimed in claim 2, in which means are provided to create a resilient bias urging said one of said contactor elements in a direction toward the other contactor element.

4. A substantially universal dual snap connector for electrostatic discharge circuits, which comprises:

(a) a metal snap stud,
said snap stud having an annular peripheral portion, (b) a metal snap receptacle,
said snap receptacle being adapted to snap on and off said snap stud,
said snap receptacle having a central opening therein, (c) a conductive plunger movably mounted coaxially in said snap stud, (d) means to create a resilient bias urging said plunger in a direction toward said snap receptacle, (e) contact means mounted in said central opening in said snap receptacle to engage said plunger and create electrical contact therewith, (f) means to insulate said plunger from said snap stud, and (g) means to insulate said contact means from said snap receptacle.

5. The invention as claimed in claim 4, in which said means to create a resilient bias is an elastomeric element.

6. The invention as claimed in claim 4, in which said snap stud has a cavity defined within said peripheral portion, said snap stud also having a central opening therein forming a bottom opening to said cavity, and in which said plunger extends through said bottom opening in said snap stud.

7. The invention as claimed in claim 6, in which said means to create a resilient bias is an electrically conductive elastomeric element mounted in said cavity.

8. The invention as claimed in claim 7, in which said elastomeric element is sponge elastomer.

9. The invention as claimed in claim 7, in which a wristband is provided having an elongate flexible portion connected at both ends thereof to a rigid connector portion, in which said snap stud is mounted on said connector portion, and in which said connector portion comprises a cover and a base between which are extended said ends of said flexible portion.

10. The invention as claimed in claim 9, in which an elongate hollow rollover eyelet connects said cover and base to each other, in which said rollover eyelet extends through said opening in said snap stud, and in which said conductive plunger extends through said rollover eyelet.

11. The invention as claimed in claim 10, in which said elastomeric element is seated in said cavity between upper ends of said plunger and rollover eyelet.

12. A dual-path receptacle and stud combination for electrostatic discharge equipment, which comprises:

(a) a metal snap receptacle having an open side and having a central portion, (b) an insulating body formed of synthetic resin and molded around said snap receptacle but not at said open side thereof, (c) a first contactor element mounted at said central portion of said snap receptacle, (d) means to insulate said first contactor element from said snap receptacle, (e) a metal snap stud adapted to mate with said snap receptacle, (f) a second contactor element mounted at the central portion of said snap stud, and (g) means to insulate said second contactor element from said snap stud,
said first contactor element and said second contactor element being so located and constructed that they mechanically and electrically contact each other when said snap receptacle and said snap stud are in mated condition.

13. The invention as claimed in claim 12, in which first circuit means are provided to connect said snap receptacle and said first contactor element through separate and independent paths to ground, and in which second circuit means are provided to connect said stud snap stud and said second contactor element through separate paths to the skin of a person.

14. The invention as claimed in claim 12, in which said first contactor element is a rollover eyelet having one end disposed to seat on said second contactor element, in which an anchor element is molded into said insulating body above said one end of said eyelet, said anchor element having a hole therethrough, said eyelet extending upwardly through said snap receptacle and through said hole in said anchor element, said eyelet being rolled over said anchor element.

15. The invention as claimed in claim 14, in which said insulating means to insulate said first contactor means from said snap receptacle is an insulating washer mounted between said anchor element and said snap receptacle, and in which an insulating shoulder washer is mounted below said snap receptacle and around said eyelet to insulate said eyelet from said snap receptacle.

16. The invention as claimed in claim 14, in which said anchor element is a washer.

17. The invention as claimed in claim 12, in which said second contactor element is a rollover eyelet, in which another rollover eyelet is provided, in which said contactor eyelet extends movably through said another rollover eyelet, in which said means to insulate said contactor eyelet from said snap stud is a shoulder washer mounted around said another rollover eyelet, in which an elastomeric washer is seated between the upper ends of said contactor eyelet and said another rollover eyelet, and in which said elastomeric washer is electrically conductive.

18. An electrostatic discharge wristband, which comprises:

(a) a band having first and second conductive portions insulated from each other, (b) a connector connecting said band together at opposed end portions thereof,
said connector having a metal base and an insulating cover between which are disposed said opposed end portions, and (c) a snap plug assembly,
said snap plug assembly comprising a metal snap stud mounted on said cover,
said snap plug assembly further comprising an insulator electrically insulating said base from only said first conductive portion of said band, said snap plug assembly further comprising a conductor electrically connecting said first conductive portion of said band to said snap stud, said snap stud, said insulator, and said conductor forming a stationary portion of said snap plug assembly, said snap plug assembly further comprising a conductive plunger movably mounted in said snap stud generally coaxially thereof, and said soap plug assembly further comprising an elastomeric element to bias said plunger in an outward direction.

19. The invention as claimed in claim 18, in which said stationary portion of said snap plug assembly further comprises an insulator insulating said plunger from said stud, and in which said elastomeric element is electrically conductive.

* * * * *

UNITED STATES PATENT AND TRADEMARK OFFICE

CERTIFICATE OF CORRECTION

PATENT NO. : 5,677,822

DATED : October 14, 1997

INVENTOR(S) : Lenard Cohen, Robert W. Weir, Robert J. West, Mark E. Hempel

It is certified that error appears in the above-identified patent and that said Letters Patent is hereby corrected as shown below:

Column 9, line 9, claim 18, between the words "said" and "plug" remove the word "soap" and insert therefor the word --snap-- .

Signed and Sealed this

Seventeenth Day of February, 1998

*Attest:*

*Attesting Officer*

Bruce Lehman

BRUCE LEHMAN

*Commissioner of Patents and Trademarks*